United States Patent [19]

Mueller et al.

[11] Patent Number: 4,497,626

[45] Date of Patent: Feb. 5, 1985

[54] HEATABLE GODET AND A METHOD OF HEATING A GODET

[75] Inventors: Kurt Mueller, Zurich; Armin Wirz, Ossingen, both of Switzerland

[73] Assignee: Rieter Machine Works, Winterthur, Switzerland

[21] Appl. No.: 533,008

[22] Filed: Sep. 16, 1983

Related U.S. Application Data

[62] Division of Ser. No. 388,235, Jun. 14, 1982, Pat. No. 4,443,689.

[30] Foreign Application Priority Data

Jun. 15, 1981 [CH] Switzerland ..... 3914/81

[51] Int. Cl.[3] ..... F27D 3/00; F27D 5/00; H05B 5/00

[52] U.S. Cl. ..... 432/9; 219/10.61 A; 432/10

[58] Field of Search ..... 432/9, 10, 225; 219/10.61 A

[56] References Cited

U.S. PATENT DOCUMENTS

| | | | |
|---|---|---|---|
| 3,600,550 | 8/1971 | Inazawa et al. | 219/10.61 A |
| 3,601,968 | 8/1971 | Wirz | 219/10.61 A |
| 4,005,302 | 1/1977 | Graf et al. | 219/10.79 |

FOREIGN PATENT DOCUMENTS

| | | | |
|---|---|---|---|
| 1806618 | 5/1970 | Fed. Rep. of Germany | 219/462 |

*Primary Examiner*—John J. Camby

*Attorney, Agent, or Firm*—Kenyon & Kenyon

[57] ABSTRACT

The circumferential wall of the godet drum is heated via air which is heated by a heating device within the chamber of the drum. Air circulation through a closed path is aided by means of fan blades which are mounted on an interior face of the drum.

3 Claims, 5 Drawing Figures

HEATABLE GODET AND A METHOD OF HEATING A GODET

This is a division of application Ser. No. 388,235 filed June 14, 1982, now U.S. Pat. No. 4,443,689.

This invention relates to a heatable godet and to a method of heating a godet.

As is known, godets or draw rolls have been known for the treatment of yarns, for example, in draw-winding, draw-twisting and spin-draw-winding machines. Generally, these godets have been heated in order to treat the threads passing thereover. In the past, various techniques have been used for heating the godets.

For example, it has been known to inductively heat a jacket or sleeve of a godet, such as described in U.S. Pat. No. 4,005,302. It has also been known to heat a godet using a vaporous medium. In such cases, a hermetically sealed space which is located between a sleeve to be heated and heating element is partially filled with a liquid. During operation, the liquid is heated to evolve a heated vapor which is then used to transmit heat to the sleeve by condensing on the sleeve such as described in German Patent DAS No. 1804777.

Generally, the vapor-type heating systems function with an above-atmosphere pressure in the sealed space. Thus, such systems present a disadvantage in that a relatively heavy construction is needed to insure stability. Further, at the increasing rotational speeds required of machines today, a heavy construction causes vibration problems in the godets. As compared to an inductively heated roll sleeve, the heat transfer in a vapor-type system can be locally adapted to the heat requirement, since the heat transfer increases proportionally with the temperature difference. In the case of an inductively heated roll sleeve, each point always generates the same predetermined quantity of heat independently of any possible local heat requirement variation. Thus, a very uneven heat distribution can result on a roll sleeve which is inductively heated. Further, such an uneven heat distribution can cause overheated points on the roll surface which may, in turn, cause a sticking of a filament material to the roll in the case of lap-up formation.

Accordingly, it is an object of the invention to provide a godet which can be heated in a relatively efficient manner while being of light weight construction. It is another object of the invention to provide a technique of heating a godet in a reliable efficient manner.

It is another object of the invention to provide a godet in which heat can be applied to a circumferential surface in a generally uniform manner.

Briefly, the invention provides a heatable godet which is comprised of a rotatable drum which defines a hollow chamber, a heating means within the drum for heating a flow of air and which includes a plurality of air guide ducts which are disposed to define a flow path of U-shaped cross-section as viewed in a circumferential direction of the drum and a plurality of fan blades on the drum for circulating air through the flow path during rotation of the drum.

The invention also provides a method of heating a godet having a circumferential wall defining a hollow chamber. The method is comprised of the steps of heating a gaseous medium within the hollow chamber and of circulating the heated medium in a substantially closed path over an inside surface of the circumferential wall.

One advantage of the godet is that the mass to be rotated is reduced to a minimum. Thus, a light weight construction can be achieved without substantially losing heat transmission advantages.

Advantageously, the fan blades can be arranged as radial fan blades on one side of the hollow chamber in such a manner that the inside surface of the circumferential wall of the drum is free for the most favorable heat transfer structures such as grooves of varying depth and/or of helical configuration.

The heating means includes a stationary support arm, a sleeve which is concentric to the arm and a plurality of ribs which interconnect the arm with the sleeve in order to define the air guide duct. In addition, the heating means may include a plurality of heating rods in the ribs, heating mats within the ducts for heating a flow of air or helical heaters which are disposed in the ducts to heat the flow of air. The ribs may also be radially disposed while extending coaxially of the support arm. This arrangement yields the advantage that no vortex is generated in the circulating flow at the exhaust of the air ducts which might otherwise reduce the sub-atmosphere pressure occurring within the air ducts.

These and other objects and advantages of the invention will become more apparent in the following detailed description taken in conjunction with the accompanying drawings wherein.

Figure 1:
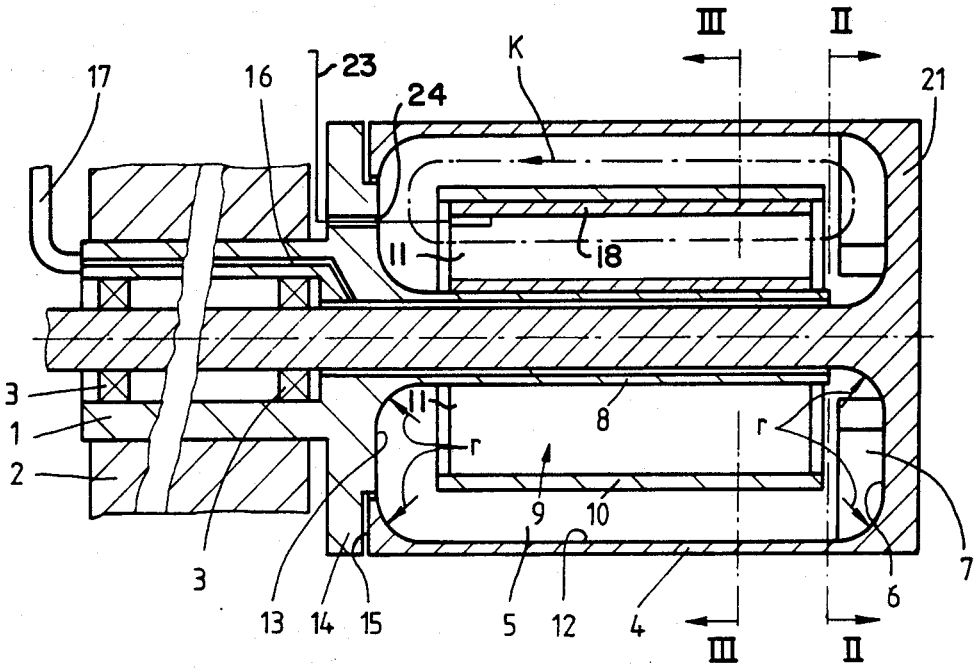
FIG. 1 illustrates a longitudinal sectional view taken on line A—A of FIG. 2 of a godet constructed in accordance with the invention.

Referring to FIG. 1, the heatable godet includes a stationary support 1 which is rigidly arranged in a machine housing 2 and a rotatable drum 4 which is journalled via bearings 3 in the support 1. The drum 4 includes a shaft which extends from bearings 3 and a circumferential wall which defines a hollow chamber 5. In addition, a plurality of fan blades 7 are mounted on the drum 4 on a annular face side 6.

In addition, a heating means is disposed within the chamber 5 of the drum 4. As indicated, the heating means includes a stationary support arm 8 which extends coaxially from the support 1 relative to the drum 4 as well as a sleeve 10 which is concentric to the arm 8 and a plurality of ribs 11 which interconnect the arm 8 and the sleeve 10 to define a plurality of air guide ducts 9 therebetween. The sleeve 10 is a rotationally symmetrical body while the ribs 11 are radially disposed (see FIG. 3) in a sun-burst manner and extend coaxially of the arm 8 in a straight manner. The ducts 9 are disposed within the chamber 5 in order to define a flow path of U-shaped cross-section as viewed in a circumferential direction of the drum 4. As indicated in FIG. 1, the free flow path is limited by the annular face side 6, and inside wall 12 of the drum 4 and a face side 13 of the chamber 5 as formed on the support 1. An extension 14 is also provided on the support 1 and has a recess which cooperates with an L-shaped surface 15 on the drum 4 to form an air gap which connects the chamber 5 with the surrounding air outside the godet.

Figure 3:
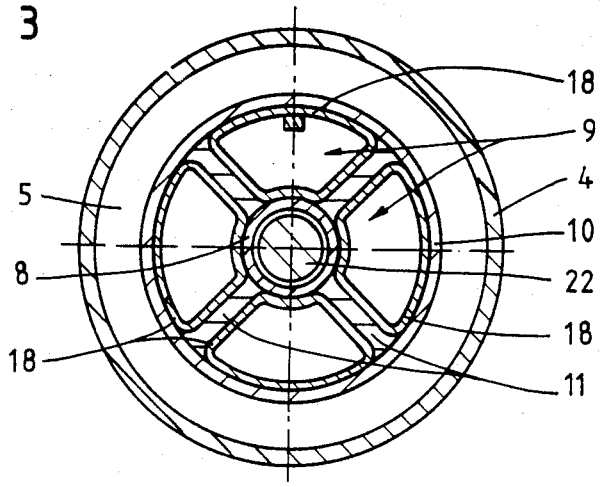
FIG. 3 illustrates a view taken on line C—C of FIG. 1.

Referring to FIG. 3, a plurality of heating mats 18 are provided in the ducts 9 along the circumference of the sleeve 10 and to both sides of the ribs 11, i.e., over the circumference of the ducts 9. These heating mats are suitably connected, for example, via electrical connections (not shown) to a source of power so as to heat air flowing through the air ducts 9.

During operation, with the heating mats 18 activated, air is heated within the air ducts 9 and begins to flow, i.e., by convection, through the air ducts 9. In addition, due to the rotation of the drum 4 relative to the heating means, an air circulation stream is generated by the fan blades 7 so that the air flows in a substantially closed flow path with a component in the direction K and a component in the direction of rotation of the drum. The two components of flow combined form a resulting direction K′ (not shown) of the circulation flow.

For aerodynamic reasons, the support 1 and drum 4 are provided with curved surfaces on a radius r where the air flow is to be deflected.

Figure 2:
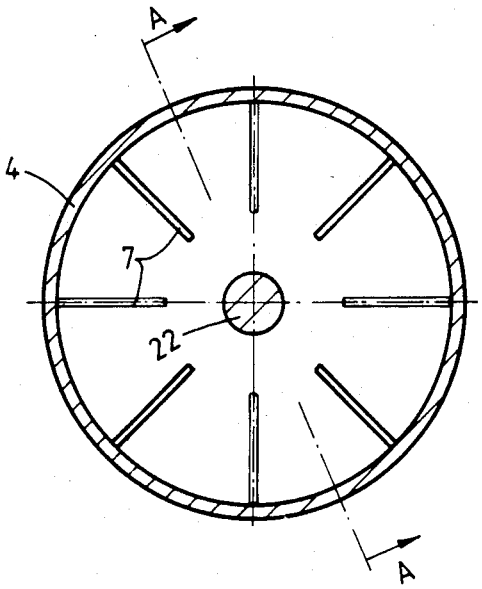
FIG. 2 illustrates a view taken on line B—B of FIG. 1.

The fan blades 7 are radially disposed (see FIG. 2) and are straight to permit reversal of the direction of rotation of the drum without impairing the aerodynamic characteristics of the circulating air. However, the fan blades 7 may also be shaped for a predetermined sense of rotation. In such case, the fan blades may be either forwardly-curved or backwardly-curved. The aerodynamic characteristics of the circulation is thus influenced in a manner which is known as such from fan technology.

Referring to FIG. 1, the support arm 8 may also be provide with a bore 16 which communicates with a compressed air line 17. Thus, the hollow chamber 5 may be supplied with compressed air in order to establish an above atmosphere pressure in order to preclude a possible contamination of the inside of the godet, for example, by fiber finish vapors. The small excessive air volume contained in the chamber 5 may then escape through the air gap along the L-shaped surface 15.

Figure 4:
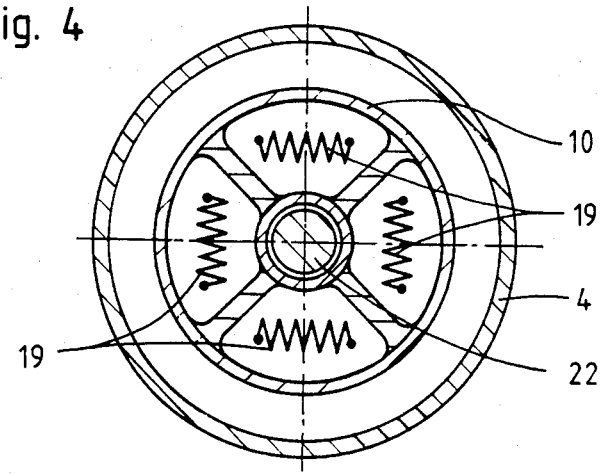
FIG. 4 illustrates a view similar to FIG. 3 of a modified heating means according to the invention.
Figure 5:
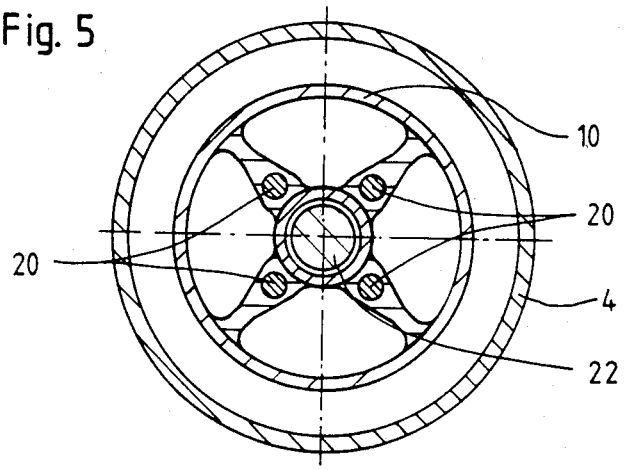
FIG. 5 illustrates a view similar to FIG. 3 of a further modified heating means according to the invention.

Referring to FIG. 4, the heating means may alternatively include a plurality of helical heaters which are located in the ducts 9 for heating a flow of air passing through the ducts 9. Alternatively, as illustrated in FIG. 5, the heating means may include a plurality of heating rods 20 which are disposed in the ribs 11.

Referring to FIG. 1, the drum 4 is constructed so that the circumferential wall, a face wall 21 and the shaft 22 form a unit which is supported in the bearings 3.

In order to transmit heat more effectively to the inside surface 12 of the peripheral drum wall, the surface is provided with a plurality of grooves (not shown). These grooves may have an increasing depth in one axial direction of the drum 4, for example, the depth of the grooves may increase, as seen in the direction of circulation flow, in inverse proportion to the decrease in temperature of the circulating air. Also, the grooves may be axially disposed or helically disposed. Further, when helically disposed, the grooves may also intersect with one another.

During heating of the godet, the heated medium is circulated by rotation of the godet and is radially accelerated via the fan blades in at least one part of the flow path. At the same time, the heated medium is circulated in the flow path by convection.

The invention thus provides a godet which can be heated internally by a flow of air or other suitable gaseous medium. By forming air ducts which extend through the hollow chamber of the drum, a simple means is provided for effecting a circulation of the heated air flow while at the same time allowing for a light weight construction of the godet.

What is claimed is:

1. A method of heating a godet having a circumferential wall defining a hollow chamber, said method comprising the steps of circulating a gaseous medium in a substantially closed free flow path of U-shaped cross-section limited by an annular face side of the godet, said circumferential wall and an opposite annular face side of the hollow chamber to heat said circumferential wall;

passing the gaseous medium from said flow path circumferentially into and through guide ducts extending between said annular face sides and circumferentially therefrom into said flow path; and heating the gaseous medium within said guide ducts by means of a heating means in order to transfer substantially the total amount of heat from the heating means to said wall by means of said gaseous medium.

2. A method as set forth in claim 1 wherein the heated medium circulated by rotation of the godet and is radially accelerated in at least one part of said closed path.

3. A method as set forth in claim 1 wherein the heated medium is circulated in said closed path by convection.

* * * * *